United States Patent [19]

Körber

[11] 4,148,468

[45] Apr. 10, 1979

[54] LANCE FOR THE FLUSH GAS TREATMENT OF NON-FERROUS MOLTEN METALS

[75] Inventor: Guntram Körber, Dusseldorf, Fed. Rep. of Germany

[73] Assignee: Messer Griesheim GmbH, Frankfurt am Main, Fed. Rep. of Germany

[21] Appl. No.: 881,127

[22] Filed: Feb. 24, 1978

[30] Foreign Application Priority Data

Mar. 3, 1977 [DE] Fed. Rep. of Germany ..... 2709155

[51] Int. Cl.$^2$ ..... C21C 7/00

[52] U.S. Cl. ..... 266/225

[58] Field of Search ..... 75/68 R, 93 E; 266/220, 266/225, 226, 233

[56] References Cited

U.S. PATENT DOCUMENTS

| | | | |
|---|---|---|---|
| 2,839,292 | 6/1958 | Bellamy | 266/225 |
| 3,033,550 | 5/1962 | Harders | 266/220 |
| 3,045,997 | 7/1962 | Hudson | 266/225 |
| 3,503,597 | 3/1970 | Kessler et al. | 266/225 |
| 3,565,412 | 2/1971 | Moniot | 266/225 |

*Primary Examiner*—Gerald A. Dost

*Attorney, Agent, or Firm*—Connolly and Hutz

[57] ABSTRACT

A lance for the flushing gas treatment of non-ferrous molten metals consists of a steel tube for connection with the flushing gas with a lance head made of gas permeable sintered metal welded onto the steel tube.

3 Claims, 1 Drawing Figure

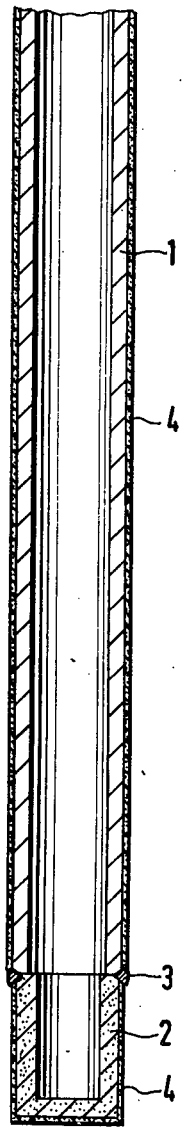
1
4
3
2
4

LANCE FOR THE FLUSH GAS TREATMENT OF NON-FERROUS MOLTEN METALS

BACKGROUND OF THE INVENTION

The invention is concerned with a lance for the flush gas treatment of non-ferrous molten metal, consisting of a steel tube with a connection for the flush gas.

The flushing of molten steels with inert gases has been practiced successfully for years. The flush gas is predominantly introduced into the pan floor by means of porous stones. Insofar as flushing from above by means of lances is concerned, one uses either a stopper rod perforated at the head or lances with an inserted porous ceramic head. The head is customarily screwed on. The crevices are sealed with fire resistant mortar and the lance tubes enveloped with fire brick. The durability of these lances is not great because of the low stability of the ceramic materials with respect to temperature changes.

As a result of the flushing of molten steels with inert gases, the molten mass is homogenized, impurities are flushed out and an even temperature distribution is attained within the molten mass. The rising gas causes a stirring effect in the molten mass which facilitates the blending in of additives. Beyond this, the flow behavior of the molten mass is generally improved.

The flushing of non-ferrous molten metals, essentially has the purpose of degasing the molten mass, in other words, to lower the hydrogen content and to flush oxide impurities to the surface.

As a result, the density values increase, the elasticity or expansion is improved and the structure becomes more fine-grained. Because of the higher purity obtainable due to the flushing, there results an improved workability in forging, rolling, drawing, as well as more problem-free surface treatment.

The more finely divided the inert flushing gas arrives in the molten mass, the better its effect.

According to the size of the charges to be flushed, various feed systems can be chosen. Ideally, the entire floor surface of the melting vessel should be gas permeable. But this can only seldom be realized for construction and heating technology reasons. For charges of between 50 and 500 kg, gas introduction by means of a lance is best suited.

A lance for the flush gas treatment of molten non-ferrous metals presents a series of requirements which could not, up to now, be fulfilled in their entirety. It must be so lightweight that it can also be handled manually. A sheating of fire bricks, as with lances for flushing molten steels, is therefore out of the question. The lance should have a practically unlimited service life. This requires good mechanical accomplishment and good resistance to sudden changes in temperature, useability for temperatures up to 1300° C. and useability for all liquid media which are in any way corrosive and need to be treated with gas. An extremely fine gas distribution is required therewith, according to which the gas bubble size lies in the $\mu$-range.

SUMMARY OF THE INVENTION

The object of the invention is to achieve a lance for the flush gas treatment of molten non-ferrous metals which fulfills all the mentioned requirements.

A lance for the flush gas treatment of molten non-ferrous metals, consisting of a steel tube with a connection for the flushing gas, was now found with which, according to the invention, the head of the lance is made of gas-permeable sintered metal and is welded onto the steel tube.

In order to make the outlet surface as large as possible, the head of the lance is designed in the shape of a cup. It is advantageous, especially when using the lance in corrosive media, if the steel tube and the lance head are coated with a protective ceramic layer. A high heat sintered metal is preferably used, for example, of WC with a Ni-Cr alloy as binding agent. The invention's lance fulfills all of the above mentioned requirements. It is, due to the absence of a heavy protective layer of fire brick, so lightweight that it can be handled manually. A good resistance to sudden changes in temperature results from the welded connection between the sintered metal and the steel tube. The steel tube, as well as the lance head of sintered metal can be used without reservations in continuous operation at temperatures up to 1300° C. The ceramic protective layer protects the steel tube as well as the lance head of sintered metal from all liquid media which are in any way corrosive. Regarding this ceramic protective layer, it is a question of a special ceramic on an enamel base. This protective layer also surrounds the grains of the sintered metal without sealing the pores. A corresponding material is known, for example, for the inner coating of self-cleaning ovens.

THE DRAWINGS

The single FIGURE illustrates a sample design of the invention, namely a cross-section of a flushing lance with a ceramic protective layer.

DETAILED DESCRIPTION

The lance consists of the steel tube 1 and the lance head 2 of sintered metal. The lance head 2 is connected with the steel tube 1 by means of a welded area 3. The connection for the flush gas on the steel tube 1 is not illustrated. The steel tube 1 as well as the lance head 2 are coated with a ceramic protective layer 4 on an enamel base.

According to another embodiment, the steel tube is, for example, bent at right angle shortly before the lance head 2. The lance head 2 is illustrated in the FIGURE as being cup-shaped; it can, however, be shaped differently. The lance head 2 could be connected to the steel tube 1 other than by a welded joint 3, for example, by a threaded joint. An increased corrosion risk would exist thereby, however, because a corrosive medium could penetrate into the threaded joint.

A particular advantage of the ceramic protective layer consists therein that it is hardly wetted by many non-ferrous metals, especially aluminum. In the case of a sudden interruption of the gas supply or a premature shutting of the gas supply due to an operating error, the pores do not immediately fill with metal and clog the sintered metal. It is heat resistant and resistant to sudden changes in temperature. The steel tube, the lance head and the protective layer are therefore, with respect to their properties, optimally compatible with one another. The good resistance to sudden changes in temperature make possible a long service life for the lance. The ceramic protective layer prevents melting away or fusion and wear. The ceramic protective coating can, of course, also be dispensed with, as for example, with media which are not very hot and not very corrosive.

What is claimed is:

1. In a lance for the flushing gas treatment of non-ferrous molten metals, consisting of a steel tube with a connection for the flushing gas for being dipped into the molten metals, the improvement being a lance head made of gas permeable sintered metal being welded onto said steel tube for injecting finely subdivided gas therethrough, and said steel tube and said lance head being coated with a ceramic protective coating without any lining of fire brick or the like to render said lance corrosion resistant against the molten metals and light-weight for manual handling thereof.

2. Lance according to claim 1, characterized by the fact that said lance head is cup-shaped.

3. Lance according to claim 1, characterized by the fact that the sintered metal consists of WC with a Ni-Cr alloy as a binding agent.

* * * * *